United States Patent [19]

Kato

[11] 4,299,289

[45] Nov. 10, 1981

[54] FIRE EXTINGUISHER HAVING A HEAT FUSIBLE MEMBER UNDER COMPRESSION

[76] Inventor: Kiyoshi Kato, 591 Ohizumigakuen-cho, Nerima-ku, Tokyo 107, Japan

[21] Appl. No.: 165,488

[22] PCT Filed: Jan. 9, 1979

[86] PCT No.: PCT/JP79/00005

§ 371 Date: Sep. 11, 1979

§ 102(e) Date: Jul. 11, 1979

[87] PCT Pub. No.: WO79/00491

PCT Pub. Date: Jul. 26, 1979

[30] Foreign Application Priority Data

Jan. 11, 1978 [JP] Japan ..... 53-1636
Jan. 18, 1978 [JP] Japan ..... 53/4143[U]

[51] Int. Cl.[3] ..... A62C 35/02; A62C 37/30

[52] U.S. Cl. ..... 169/57; 169/9; 169/26; 169/42; 169/85

[58] Field of Search ..... 169/9, 11, 26, 28, 57, 169/42, 74, 85, 89; 222/4, 5, 82, 83.5, 86, 88; 239/309; 137/72

[56] References Cited

U.S. PATENT DOCUMENTS

| | | | |
|---|---|---|---|
| 1,263,291 | 4/1918 | Schultz | 169/9 |
| 2,585,039 | 2/1952 | Roore | 169/9 |
| 2,674,324 | 4/1954 | Mascarini | 169/9 |
| 2,684,180 | 7/1954 | Allen | 169/85 X |
| 2,819,764 | 1/1958 | Anthony, Jr. | 169/9 X |
| 3,768,567 | 10/1973 | Weise | 169/26 |

*Primary Examiner*—Robert J. Spar
*Assistant Examiner*—Fred A. Silverberg

[57] ABSTRACT

The present invention relates to a fire extinguisher which comprises vessels (1, 18) filled with a fire extinguishing solution, an actuating element that breaks the vessels to eject the solution due to the occurance of fire. The actuating element is retracted against the force of a spring by a holder which is locked by a set screw (41) for exerting a pressure thereto through a heat fusible element (42) for fire detection so that the heat fusible element (42) is placed perpetually under compression. Since the heat fusible element (42) is normally subjected to compression, the element is less liable to deterioration with time.

4 Claims, 3 Drawing Figures

FIRE EXTINGUISHER HAVING A HEAT FUSIBLE MEMBER UNDER COMPRESSION

FIELD OF THE INVENTION

This invention relates to a fire extinguisher designed for detecting the occurrence of a fire and immediately breaking a seal of a tank containing the fire extinguishing solution for ejecting the same into an enclosure.

BACKGROUND OF THE INVENTION

Fire extinguishers are known in the art for detecting the increase in temperature of an enclosure due to fire occurrence and operating to extinguish the fire at the earlier stage. These known devices may be roughly classified into a device in which the opening of a vessel filled with a fire extinguishing gas under an elevated pressure is covered with a sealing cap which may be ruptured upon detection of a fire to permit the gas within the vessel to be injected into the enclosure; and a device comprising a vessel containing a high pressure gas and a tank containing a fire extinguishing solution and in which a sealing cap for the opening of the vessel is broken upon a fire detection to permit the gas within said vessel to flow into said tank for driving the solution into the enclosure.

An actuating device used in these fire extinguishers for breaking the sealing cover upon a fire occurrence is so designed that a striker acted on by a spring urged towards a sealing cover or a hammer acted on by a spring for applying an impact on a striker head of the sealing cover is held in a stationary position by a holding member made of heat fusible material such as solder. The holder may be fused under the heat of the fire to permit the striker to impinge and sever the sealing cover. With such known devices, the holder made of heat fusible material is placed perpetually under a shearing or tensile force and therefore may be deteriorated with time due to creep and temperature changes in the enclosure, thus causing the operation of the fire extinguisher on an occasion other than an actual fire.

So far, a cylindrical or spherical tank was used for containing a fire extinguishing solution. Such a tank has a poor appearance when mounted to the ceiling because of increased vertical size and may be undesirable to residents. Moreover, with such tank shapes, a gas vessel and means for breaking a seal on the gas vessel must be provided within the tank, thus complicating the structure of the device.

SUMMARY OF THE INVENTION

The fire extinguisher of the present invention is so designed and constructed that energy is stored in a spring which is held stationarily by a holder, and a striker for breaking a seal on a tank containing a fire extinguishing solution or a hammer applying an impact on the striker is actuated by said spring. The holder may be unlocked and the energy stored in the spring caused to act on the striker when the room temperature has increased beyond a predetermined value, the vessel being thereby opened to permit the solution to flow into the enclosure by way of a nozzle. According to the present invention, a heat fusible element is provided between said holder to be locked and a set screw for exerting a pressure thereto and placed perpetually under compression. As the heat fusible element responsible for fire detection is subjected to compression in this way it provides a safeguard against an erroneous operation as is frequently encountered with known devices in which the holder for storing the energy in the spring may be deteriorated with time due to a creep phenomenon and hence may be accidentally broken for actuating the fire extinguisher on an occasion other than an actual fire.

According to the present invention, a vessel containing the fire extinguishing solution is comprised of a gas vessel filled with a high pressure gas and having a sealing cover which is adapted to be broken by a striker, and a tank containing a fire extinguishing solution designed to be ejected into the enclosure through a nozzle along with the high pressure gas. Hence, more solution can be stored for ejection in case of an actual fire. With the fire extinguisher having a high pressure gas vessel and a separate solution tank, the latter tank may be in a toroidal or doughnut-like shape and mounted adjacent to a connector connecting the gas vessel and the solution tank. Thus, the fire extinguisher is not bulky even if the solution should be contained in the tank in an amount sufficient for fire extinguishment.

DESCRIPTION OF A PREFERRED EMBODIMENT

Figure 1:
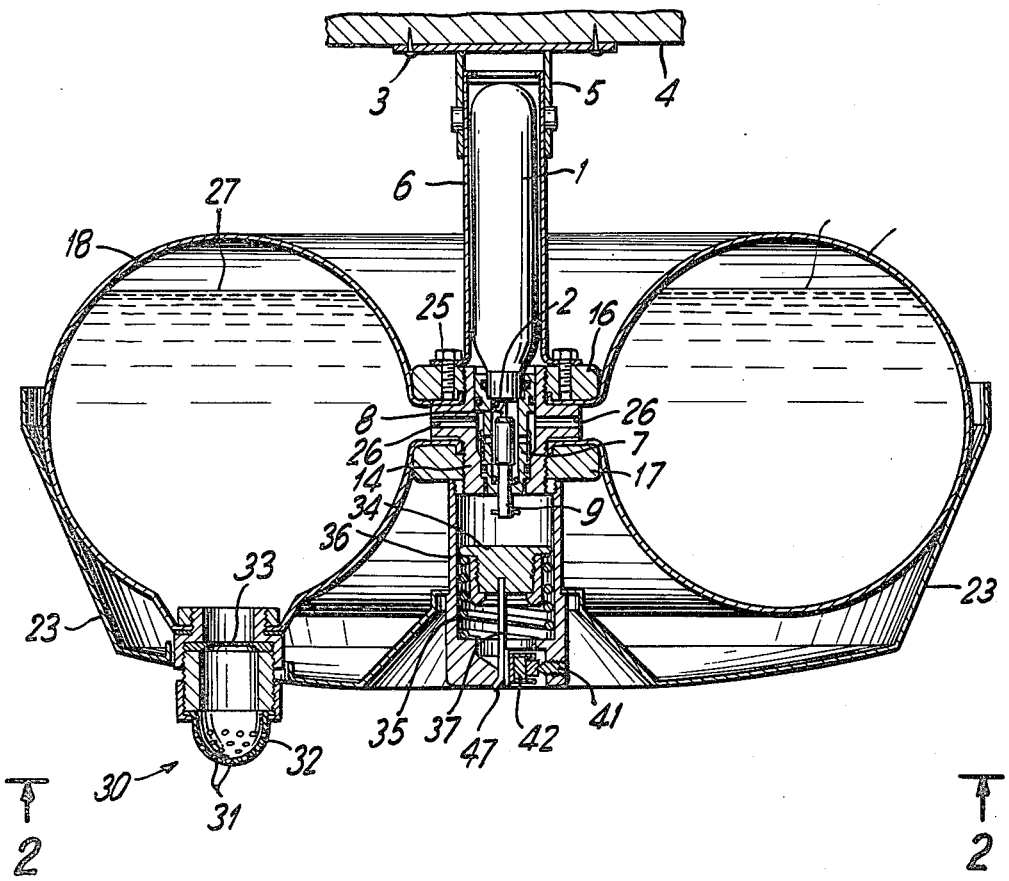
FIG. 1 is a sectional view of a fire extinguisher according to a preferred embodiment of the present invention.
Figure 2:
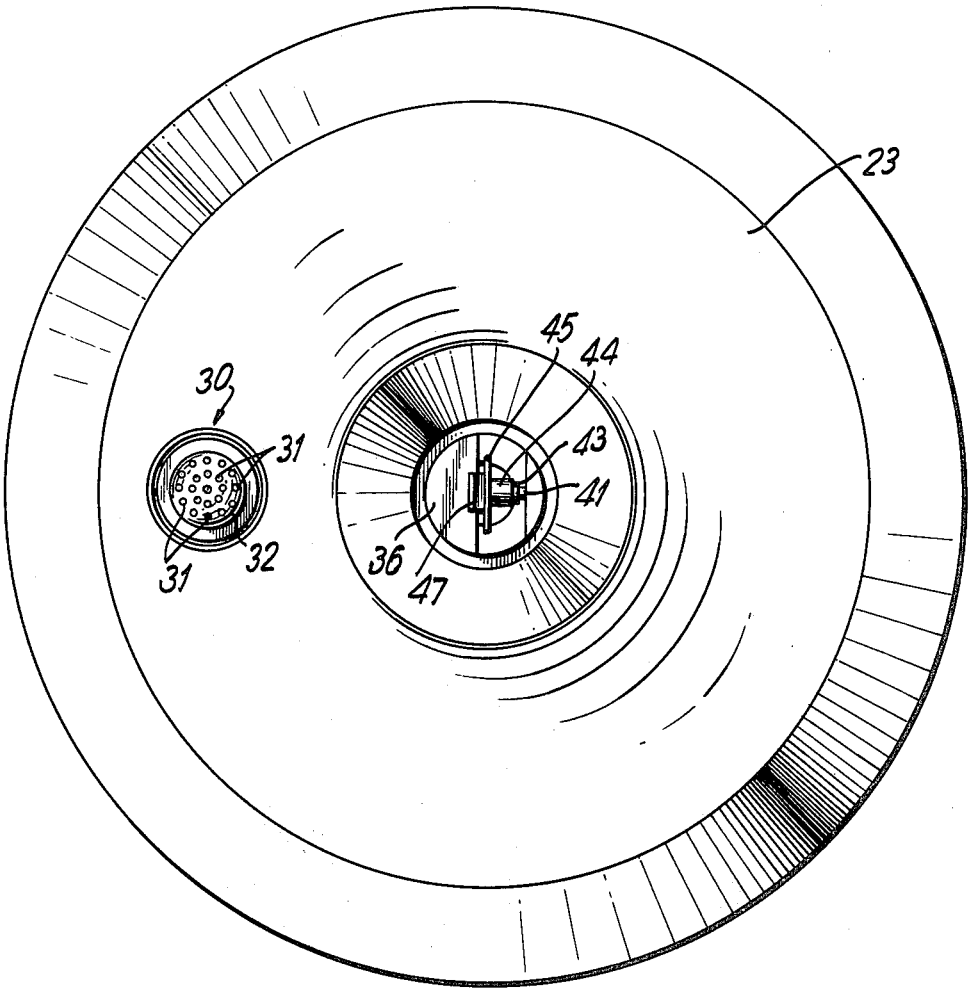
FIG. 2 is a bottom view looking in the direction of the arrows of FIG. 1.
Figure 3:
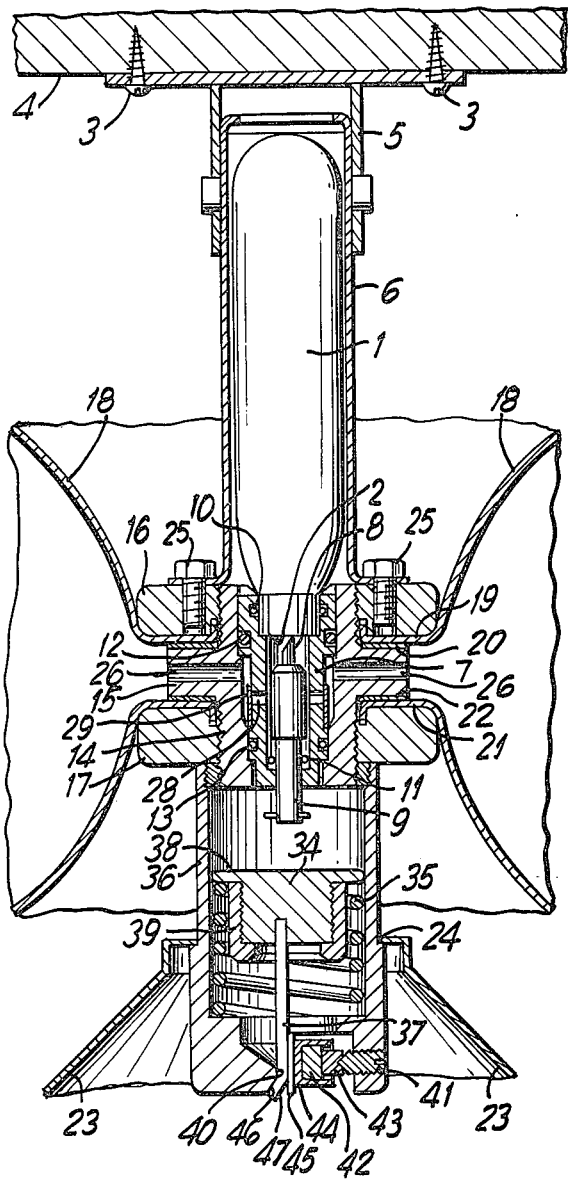
FIG. 3 is an enlarged sectional view showing a portion of the embodiment of FIG. 1.

A gas vessel 1 is filled with an inert gas such as carbon dioxide under elevated pressure, and has a foremost part provided with a cap 2 for sealing. The vessel 1 is housed within a casing 6 with said foremost part downwards. The casing 6 has a mounting metal fixture 5 at the upper end and is designed to be secured to the ceiling 4 at said mounting fixture by bolts or screws or similar fastening means. An inner cylindrical connector 7 is fitted to the foremost part of the gas vessel 1, as shown in FIGS. 1 and 3. A striker 9 having a knife edge 8 for breaking the cap 2 in the case of a fire is carried slidably axially within said connector 7 and in opposition to said cover 2. An O-ring 10 is interposed between the vessel 1 and the connector 7 as shown in FIG. 3, and another O-ring 11 is interposed between the striker 9 and the connector 7 for sealing.

An outer connector 14 is fitted on said inner connector 7 and sealed therefrom by a pair of O-rings 12, 13. The connector 14 has a central flange portion 15 and is engaged by an upper nut 16 and a lower nut 17. A toroidal or doughnut-shaped tank 18 is provided adjacent to the outer connector 14. Tank 18 has an upper flange 19 connected to said connector 14 with a seal 20 interposed therebetween and a lower flange 21 connected to said connector 14 with another seal 22 interposed therebetween. The lower portion of tank 18 is covered by a cover 23 which is carried by a step 24 formed on the outer connector 14. The casing 6 is secured to the outer connector 14 by bolts 24 threaded into tapped holes in the upper nut 16.

The outer connector 14 is formed with a plurality of radial gas conduits 26 for directing the gas within the vessel 1 into the tank 18. When the cover 2 is broken by impact afforded by the striker 9, the gas in the vessel 1 flows into the tank 18 filled with a fire extinguishing solution 27. The gas contained in the vessel 1 may be supplied to the conduits 26 by way of ports 28 formed in the inner connector 7. These ports 28 are usually closed by a tube 29 of rubber or similar material which is fitted into the ports 28. The tube 29 may be ruptured only when the gas has been ejected from the vessel 1 to permit the gas to flow into tank 18.

The solution 27 within the tank 18 may be ejected into the space below through a nozzle device 30 along with the inert gas contained in the vessel 1. The device 30 has, as shown in FIG. 1, a dome-shaped cap 32 formed with a number of ejection openings 31 and a diaphragm 33 made of rubber or similar material. The diaphragm 33 is designed for normally blocking the solution 27 from flowing therethrough and to be ruptured only when the inert gas contained under elevated pressure within vessel 1 flows into the tank 18 upon breakage of the sealing cap to permit the solution 18 to flow into the space therebelow along with the high pressure inert gas.

A hammer 34 for impinging the striker 9 and a compression spring 35 acting resiliently on the hammer 34 are contained in a frame 36 which is secured at the upper end thereof to the outer connector 14. A holder 37 is secured at the upper end thereof to the hammer 34 and engaged at the lower end thereof by the lower end of the frame 36 so as to retract the hammer 34 downwards against the force of spring 35. A guide member 39 is threadedly mounted to the hammer 34 for guiding the spring 35 into contact with the lower face of a flange 38 of the hammer 34. A tubular member 44 and a plate 45 are interposed between the lower end of the holder 37 and a set screw 41. The latter screw 41 operates for pressing the holder 37 against a contact surface 40 of the frame 36 for locking the holder 37 in position. The tubular member 44 has a plunger 43 engaged by the screw 41, and a heat fusible element 42 therein, said element 42 comprising a low melting alloy material. The lower end of the holder 37 has a bent portion 47 abutting on an inclined surface 46 of the frame 36. The holder 37 is locked in the position shown in FIGS. 1 and 3 under the friction exerted from the set screw by way of the heat fusible element and the plate 45 and the engagement of the bent portion 47 with the inclined surface 46.

In operation, the fire extinguisher of the present invention is screwed to the ceiling 4, as shown in FIG. 1. In cases a fire has broken out and the room temperature has increased to a certain level, the element 42 housed within the member 44 is fused so as to flow out through a gap between the member 44 and the plunger 43 or through openings in the member 44, not shown. The spring force exerted by the compression spring 35 on the holder 37 acts for disengaging the bent portion 47 from the inclined surface 46 and unlocking the holder 37. The hammer 34 is urged to impinge on the striker 9 under the force of the compression spring and the knife edge 8 formed at the foremost part of the striker 9 severs the cap 2 of the vessel 1 to permit the gas therein to pass through the conduits 26 into the tank 18. The diaphragm 33 is then broken under the high pressure now prevailing in the tank to permit the solution 27 contained therein to flow into the space therebelow through orifices 31 of the nozzle device 30 along with the inert gas for extinguishing the fire.

The heat fusible element 42 made of low melting alloy material and designed for sensing the occurrence of a fire is normally urged by a plunger 43 within the tubular 44 for compression. Thus, the element is not subjected to a tensile force as when the element is designed as a holder 37 and therefore is less liable to deterioration with time. Moreover, the fire extinguisher of the present invention is not liable to come into erroneous operation on occasions other than actual occurrence of a fire. In addition, since the tank 18 has a toroidal or doughnut-like shape and may be mounted around the outer connector 14, the inert gas contained in the vessel 1 can be transferred instantly into the tank 18. Also when the tank 18 is of such a capacity as to contain as much solution 27 as is required for extinguishing the fire occurring in a room or enclosure, the vertical dimension of the toroidal tank 18 may be minimized.

With a tank 18 of 36 liters and a vessel 1 of 15 liters in capacity, as a typical example, the solution 27 will flow out continuously through the nozzle 30 for about 20 seconds to extinguish the fire that has occurred in a room having a surface area of 10 $m^2$.

What is claimed is:

1. A fire extinguisher comprising a vessel containing a high pressure gas with the inside thereof maintained at a pressure above the atmospheric pressure;

a striker for breaking a cover sealing said vessel;

a frame accommodating a spring applying an impact pressure to said striker;

a holder for storage of resilient energy in said spring;

a set screw mounted in said frame for mounting said holder in position; and a heat fusible member interposed between said set screw and said holder for applying the pressure of said set screw to said holder, said member being fusible under the heat of the fire and placed permanently under a compressive force.

2. A fire extinguisher comprising a gas vessel filled with a high pressure gas;

a tank containing a fire extinguishing solution and having an ejection nozzle;

a metallic connector secured to said vessel and said tank and including a striker and gas conduit means, said striker operating to break a sealing cap for said gas vessel and said conduit means operating for guiding the high pressure gas therethrough into said tank when said sealing cap is broken by said striker;

a frame housing a hammer secured to said connector and designed for applying an impact to said hammer, and a spring for affording a force to said hammer;

a holder secured at one end to said hammer and at the other to said frame for retracting said hammer towards it against the force of said spring;

a set screw secured to said frame for exerting a clamping force to said holder; and a heat fusible element housed within a tubular member in a position intermediate said set screw and said holder and being fusible out of said tubular member under the heat generated by the fire for unlocking said holder; said heat fusible element being normally placed under a compressive force.

3. A fire extinguisher as defined in claim 2 further comprising a casing for housing said gas vessel therein, said casing having at the upper end thereof a fitting for securing to a ceiling and being mounted at the lower end thereof to said fitting;

said tank comprising an annular tank mounted surrounding said fitting;

a nozzle device mounted to said tank and having a number of openings for ejecting the solution in said tank therethrough with the high pressure gas from said gas vessel; and diaphragm means mounted in said nozzle device and operative for normally preventing the leakage of said solution in the tank and for being broken in case of fire as a result of the gas in said gas vessel flowing into the tank through said gas conduits.

4. A fire extinguisher as defined in claim 3 wherein said holder is formed with a bent portion contacting with an inclined surface in said frame, and wherein said holder is designed to be locked relative to said frame under the friction between it and said frame and the engagement of said bent portion with said inclined surface.

* * * * *